US011255105B2

(12) United States Patent
Poiré et al.

(10) Patent No.: US 11,255,105 B2
(45) Date of Patent: Feb. 22, 2022

(54) LOCKING SYSTEM FOR DOOR, AND EXTENDIBLE WIRE CONDUIT THEREFORE

(71) Applicant: DORMAKABA CANADA INC., Montréal (CA)

(72) Inventors: André Poiré, Montréal (CA); Patrice Magnan, Montréal (CA); Abderrahim El Ouafi, Boisbriand (CA)

(73) Assignee: DORMAKABA CANADA INC., Montréal (CA)

( * ) Notice: Subject to any disclaimer, the term of this patent is extended or adjusted under 35 U.S.C. 154(b) by 394 days.

(21) Appl. No.: 16/473,305

(22) PCT Filed: Mar. 23, 2018

(86) PCT No.: PCT/CA2018/050354
§ 371 (c)(1),
(2) Date: Jun. 25, 2019

(87) PCT Pub. No.: WO2018/184098
PCT Pub. Date: Oct. 11, 2018

(65) Prior Publication Data

US 2021/0285254 A1 Sep. 16, 2021

Related U.S. Application Data

(60) Provisional application No. 62/481,732, filed on Apr. 5, 2017.

(51) Int. Cl.
*E05B 9/08* (2006.01)
*E05B 47/00* (2006.01)
(Continued)

(52) U.S. Cl.
CPC ..... *E05B 9/08* (2013.01); *E05B 47/0001* (2013.01); *G07C 9/00571* (2013.01); *E05B 63/006* (2013.01); *E05B 65/0032* (2013.01)

(58) Field of Classification Search
CPC ..... E05B 9/08; G07C 9/00
See application file for complete search history.

(56) References Cited

U.S. PATENT DOCUMENTS 995,818 A 6/1911 Voight
2,308,322 A 1/1943 Voight
(Continued)

FOREIGN PATENT DOCUMENTS

DE 102006001267 B3 5/2007
EP 0978611 A2 2/2000
JP 2007120139 A 5/2007

*Primary Examiner* — K. Wong
(74) *Attorney, Agent, or Firm* — Norton Rose Fulbright Canada LLP; Alexandre Daoust

(57) ABSTRACT

The locking system can have an outer housing mounted to an outside face of the door, and an inner housing mounted to an inside face of the door, a wire conduit mounted to one of the inner housing and the outer housing and extending across the door to the other one of the inner housing and the outer housing, the wire conduit having two telescoping members, and at least one wire extending inside the wire conduit and connected between a first locking system component housed in the outer housing and a second locking system component housed in the inner housing.

12 Claims, 10 Drawing Sheets

(51) Int. Cl.

| | |
|---|---|
| ***G07C 9/00*** | (2020.01) |
| *E05B 63/00* | (2006.01) |
| *E05B 65/00* | (2006.01) |

(56) References Cited

U.S. PATENT DOCUMENTS

| | | | | |
|---|---|---|---|---|
| 2,320,177 | A | 5/1943 | Golden et al. | |
| 3,358,483 | A | 12/1967 | Wellekens | |
| 3,815,390 | A | 6/1974 | Stoia | |
| 3,899,907 | A | 8/1975 | Prahl | |
| 3,934,437 | A | 1/1976 | Crepinsek | |
| 4,573,334 | A | 3/1986 | Crepinsek | |
| 4,923,670 | A | 5/1990 | Deforrest | |
| 6,412,317 | B1 | 7/2002 | Martin | |
| 6,553,799 | B2 | 4/2003 | Bates et al. | |
| 8,690,205 | B2 | 4/2014 | Benitez et al. | |
| 9,187,929 | B2 * | 11/2015 | Webb | E05C 1/16 |
| 2005/0179267 | A1 | 8/2005 | Cote et al. | |
| 2008/0003876 | A1 | 1/2008 | Fukaya et al. | |
| 2009/0027194 | A1 | 1/2009 | McGrath | |
| 2009/0275229 | A1 | 11/2009 | Neumayer et al. | |
| 2009/0308117 | A1 | 12/2009 | Goldman | |
| 2011/0174029 | A1 | 7/2011 | Lappalainen et al. | |
| 2014/0159480 | A1 | 6/2014 | Totani | |

* cited by examiner

LOCKING SYSTEM FOR DOOR, AND EXTENDIBLE WIRE CONDUIT THEREFORE

FIELD

The improvements generally relate to the field of electrical locking systems for doors of buildings.

BACKGROUND

Various forms of electrically-powered locking systems for doors exist. Such locking systems are widely used in hotels, motels and other rental dwellings, but are also used in many other applications. Such locking systems typically have a controller, often provided in the form of a relatively simple computer, which has an input interface to receive an input serving as the "key". The controller 20 performs an authentication function determining whether or not the input from the electronic key 22 is authorized to operate the lock, and controls a lock actuator 24 to open the lock 26 upon authorization. In most cases, the key 22 is electronically coded as part of an electronic key (e.g. data 30 on a swipe card, chip card, RFID card, or data stored on a computer memory such as a smartphone memory) and the locking system has a reader interface 32 to read it in a contact or a contactless manner (e.g. swipe interface, card readers, reader antennas, "tap" readers, Bluetooth™). Alternately, the key data can be a memorized number which is entered via a keypad provided as part of the locking system, for instance. Typically, such locks are also self-powered and thus also include a battery.

A specific example of such a locking system 10 assembled to a door 12 is shown in FIGS. 1A and 1B. This specific locking system is of the 'mortise type' and has the lock provided in a pocket 14 which is loaded into a corresponding cavity—the mortise—which is defined in the door 12. The various electrical (including electronic) components can include some components housed in the outer housing 16, and other components housed in the inner housing 18.

When the lock 26 is open following positive authentication, the outside lever 33 can be activated to retract the latch 34, allowing subsequent opening of the door. Typically, in this type of locking system 10, the inside lever 35 is not lockable, though it is common for an additional bolt 36 to be provided which can be manually and mechanically activated from the inside via a bolt actuator 38 (typically a simple knob).

Known systems were satisfactory to a certain degree. However, there always remains room for improvement.

SUMMARY

In electrical locking systems, an electrical conduit can be provided between the outside housing and the inner housing, to provide a passage for electrical wires therebetween. Cost and quality vs. price ratio control are standing concerns in the design of locking systems, in addition to other concerns such as style, durability, security, etc. Doors come in various thicknesses. It was found advantageous to provide locking system models which could adapt to various thicknesses of doors. Indeed, providing different locking system models for different sizes of doors could significant affect overall costs given the additional complexity of managing a more complex inventory and the increased likelihood of errors and problems at installation. It was found advantageous to provide an electrical conduit which was extendible and thus adaptable to various thicknesses of doors.

In accordance with one aspect, there is provided: a locking system for a door having a lock, comprising an outer housing mounted to an outside face of the door, and an inner housing mounted to an inside face of the door, a wire conduit mounted to one of the inner housing and the outer housing and extending across the door to the other one of the inner housing and the outer housing, the wire conduit having two telescoping members, and at least one wire extending inside the wire conduit and connected between a first locking system component housed in the outer housing and a second locking system component housed in the inner housing.

It will be understood that the expressions 'computer' and 'controller', as used herein, are not to be interpreted in a limiting manner. A controller can be a computer or some other form of electronic or electrical device which is adapted to perform a controlling function. The expression 'computer' is used in a broad sense to generally refer to the combination of some form of one or more processing units and some form of memory system accessible by the processing unit(s). A computer can be a network node, a personal computer, a smart phone, an appliance computer, etc.

It will be understood that the various functions of the computer, or more specifically of the processing unit, can be performed by hardware, by software, or by a combination of both. For example, hardware can include logic gates included as part of a silicon chip of the processor. Software can be in the form of data such as computer-readable instructions stored in a memory system.

In accordance with another aspect, there is provided a method of installing a locking system, the method comprising extending a telescoping wire conduit mounted to one of the outer housing and the inner housing of the locking system, mounting the outer housing to an outer face of the door and the inner housing to an inner face of the door, including engaging a free end of the extended telescoping wire conduit across the door, and connecting at least one wire extending out from the free end of the wire conduit.

Many further features and combinations thereof concerning the present improvements will appear to those skilled in the art following a reading of the instant disclosure.

DESCRIPTION OF THE FIGURES

In the figures,

FIGS. 3C and 3D are oblique views showing the telescoping wire conduit mounted to a door;

DETAILED DESCRIPTION

Figure 1A:
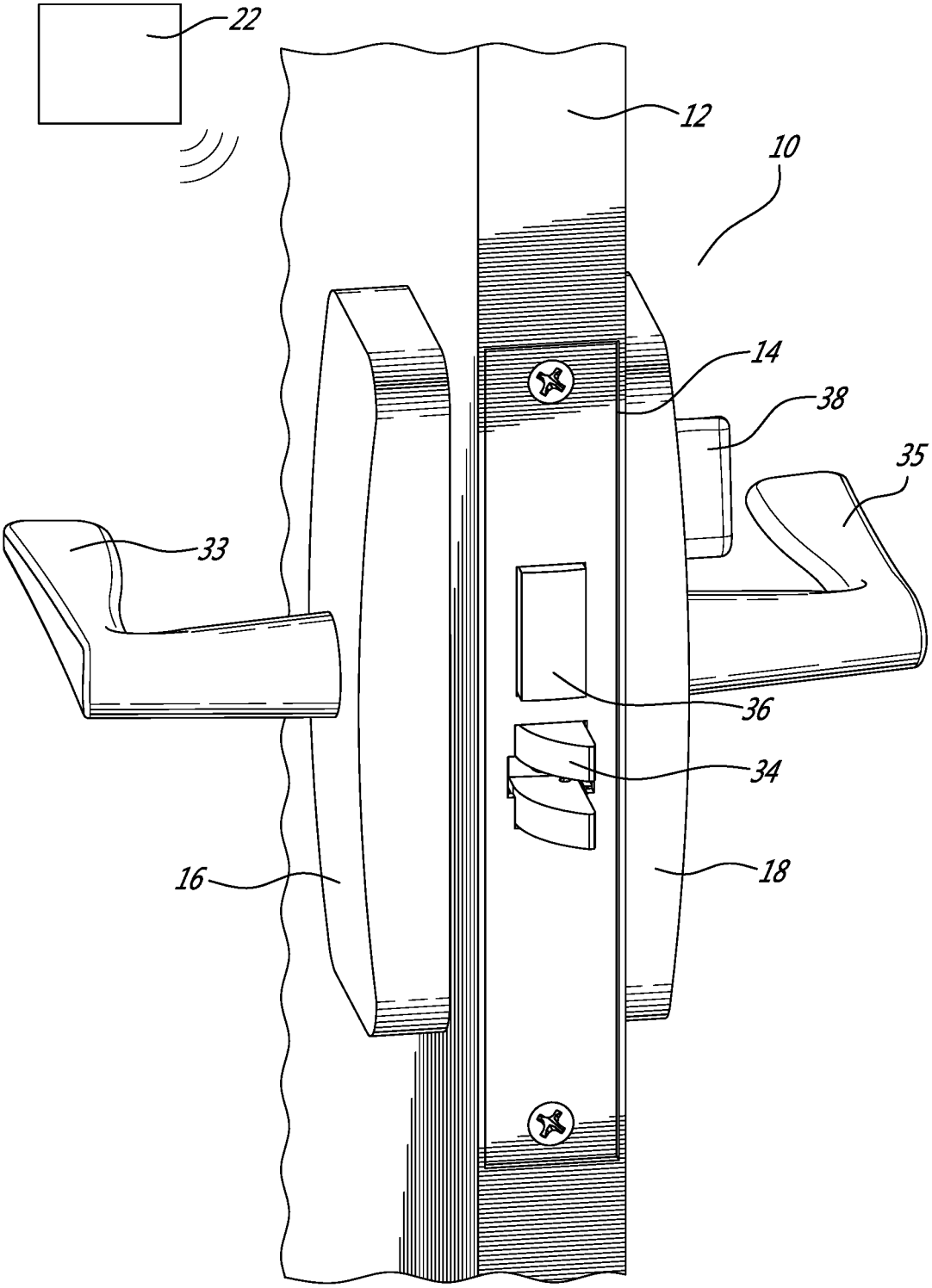
FIG. 1A Prior Art
FIG. 1A is an oblique view of an example of a locking system mounted to a door, in accordance with the prior art.
Figure 1B:
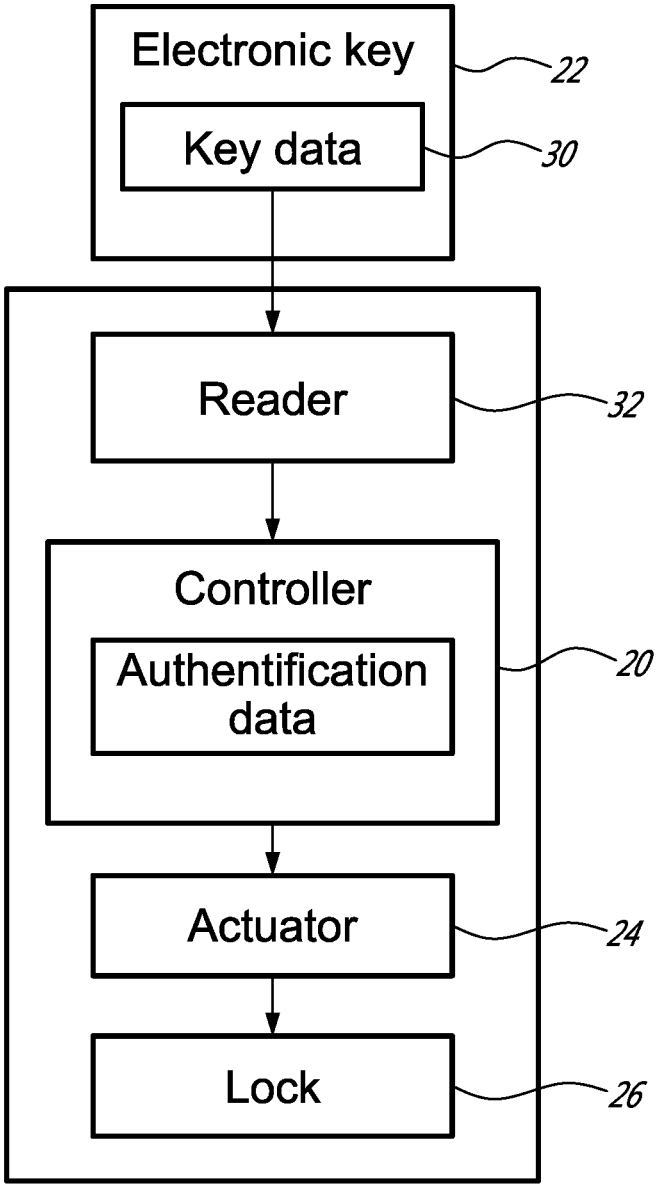
FIG. 1B Prior Art
FIG. 1B is a block diagram showing the communication flow between an electronic key and a locking system.
Figure 2B:
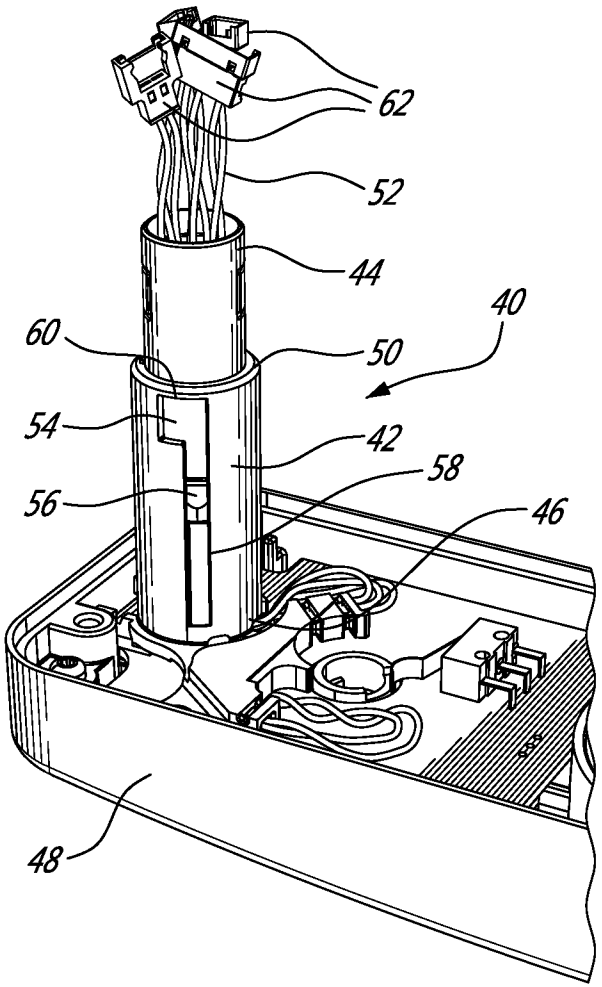
FIGS. 2A and 2B are oblique views showing a first example of a telescoping wire conduit in an extended, and a retracted configurations, respectively.
Figure 2A:
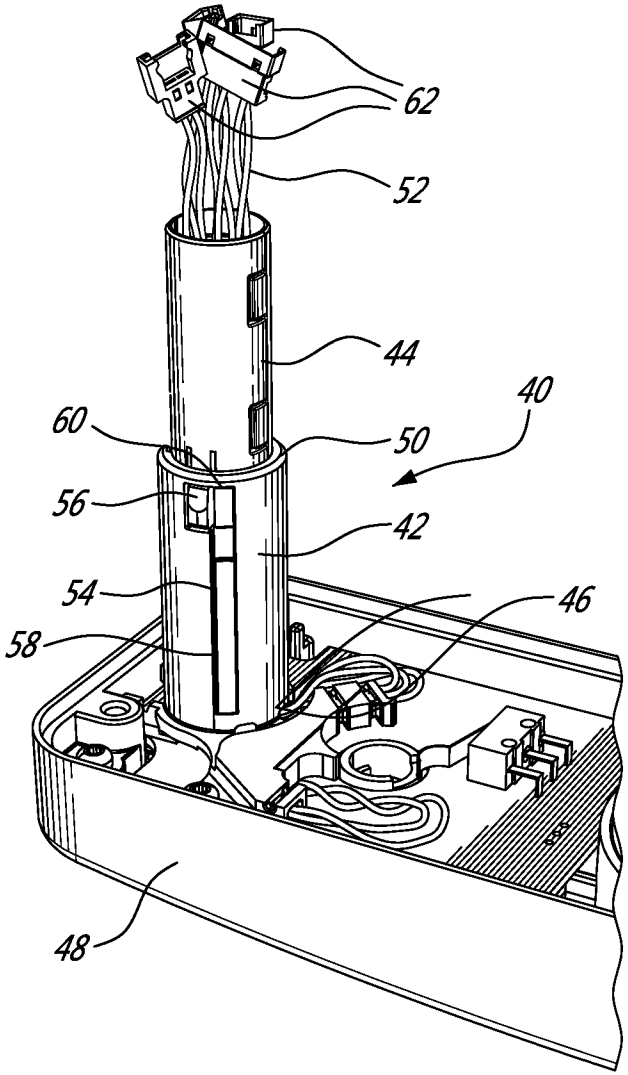

FIGS. 2A and 2B show a first example of a telescoping wire conduit 40. In these figures, the telescoping wire 40 conduit includes a base member 42 and an extension member 44. The base member 42 has a proximal end 46 secured to the outer housing 48 and a distal end 50 protruding from the outer housing 48, opposite the proximal end 46, for extending into the door and guiding the wires 52 across the thickness of the door. The extension member 44 is telescopingly mounted to the base member 42. It will be understood that although the telescoping wire conduit 40 is made integral to the outer housing 48 in this embodiment, more specifically due to the fact that the proximal end 46 of the base member 42 is secured to the outer housing 48, the telescoping wire conduit 40 can be instead secured to the inner housing 18 and extend away from the inner housing 18, across the door 12, in alternate embodiments.

Moreover, in this embodiment, the relative telescoping movement of the extension member 44 relative the base member 42 is guided and is lockable, via a keyway 54 and key 56 engagement. More specifically, the base member 46 has a keyway 54. The keyway 54 forms an inverted L, with a longitudinal segment 58 extending longitudinally between the proximate end 46 and the distal end 50, and a circumferential segment 60 at the distal end 50. A mating key 56 is provided in the form of a radial protuberance formed in the extension member 44. Accordingly, the locking system can be shipped with the telescoping wire conduit 40 being positioned in a retracted state. At the time of assembly, the extension member 44 can be extended and its key 56 can be pulled along the longitudinal segment 54 of the keyway 58, and then locked in the extended state shown in FIG. 2A by rotating the extension member 44 to move the key in the circumferential segment 60. At this stage, the locked wire conduit can be engaged across the door, and protrude into the inside housing, across a back plate thereof (the cover of the inside housing will typically have been removed for installation), at which stage the wires 52, or more specifically the connectors 62 thereof, will be accessible to the assembly technician on the other face of the door. The assembly technician can then connect the wires 52 to connect any of the electrical components which need a wired connection across the door. Once the connection has been completed, the technician can rotate the extension member 44 to move the key 56 back into the longitudinal segment 58, and can push the extension member 44 in a manner to move the key 56 along the longitudinal segment 58, and thus retract the extension member 44 back into the door, to the extent desired (e.g. such as shown in FIG. 2B). The cover can then be replaced onto the internal housing to complete the installation.

Various modifications to this specific example are possible. For instance, in this embodiment, the base member 42 has a keyway 58 and the extension member 44 has a key 56, but it will be understood that in alternate embodiments, the extension member 44 can have a keyway 58 and the base member 42 have a key 56.

Figure 3A:
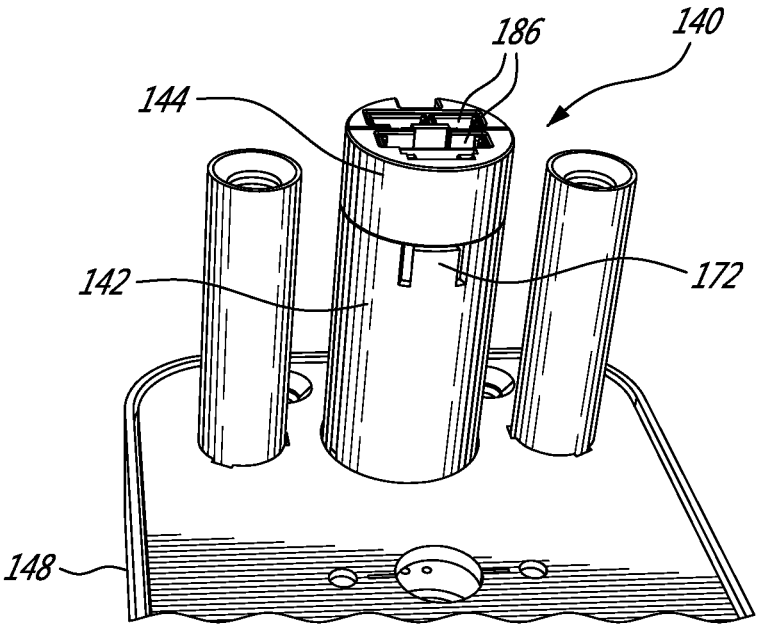
FIGS. 3A and 3B are oblique views showing a second example of a telescoping wire conduit in a retracted, and an extended configurations, respectively.
Figure 3B:
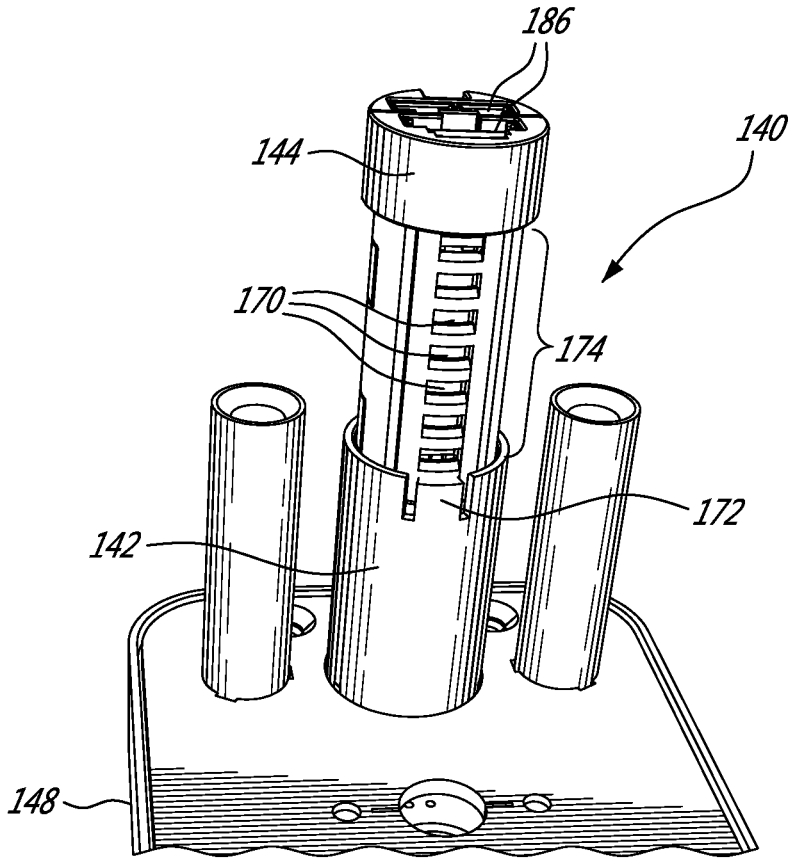
Figure 3C:
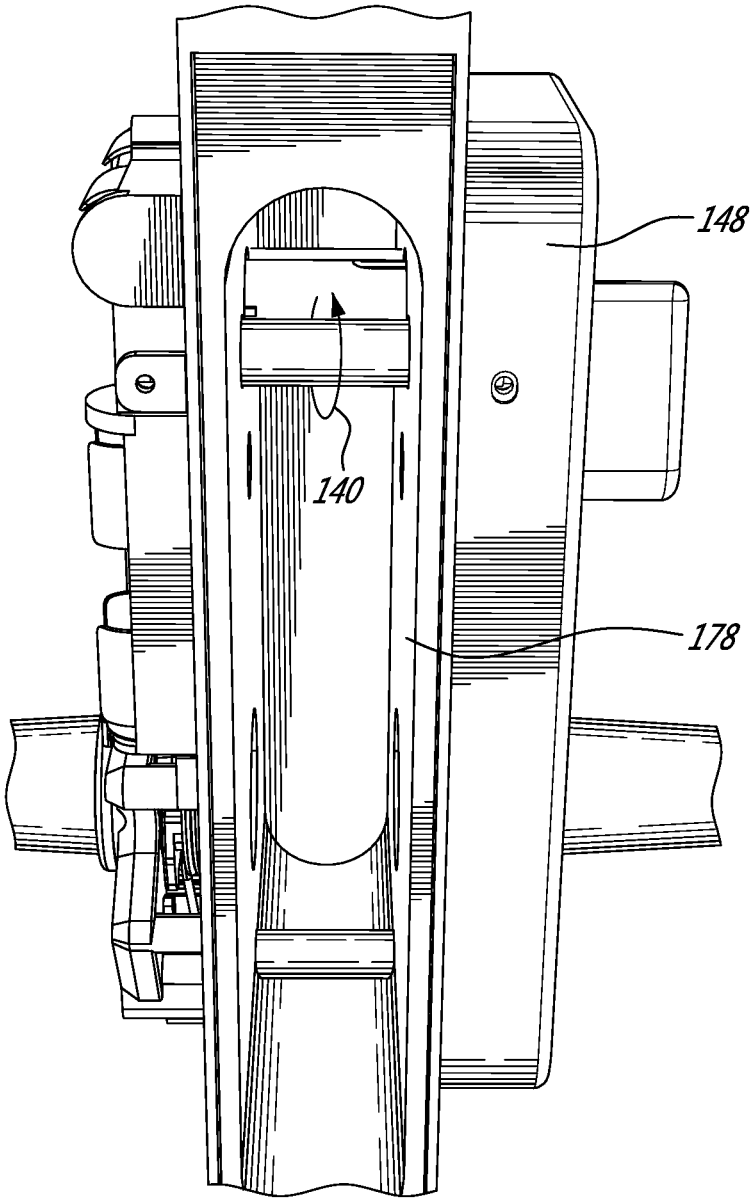
Figure 30:
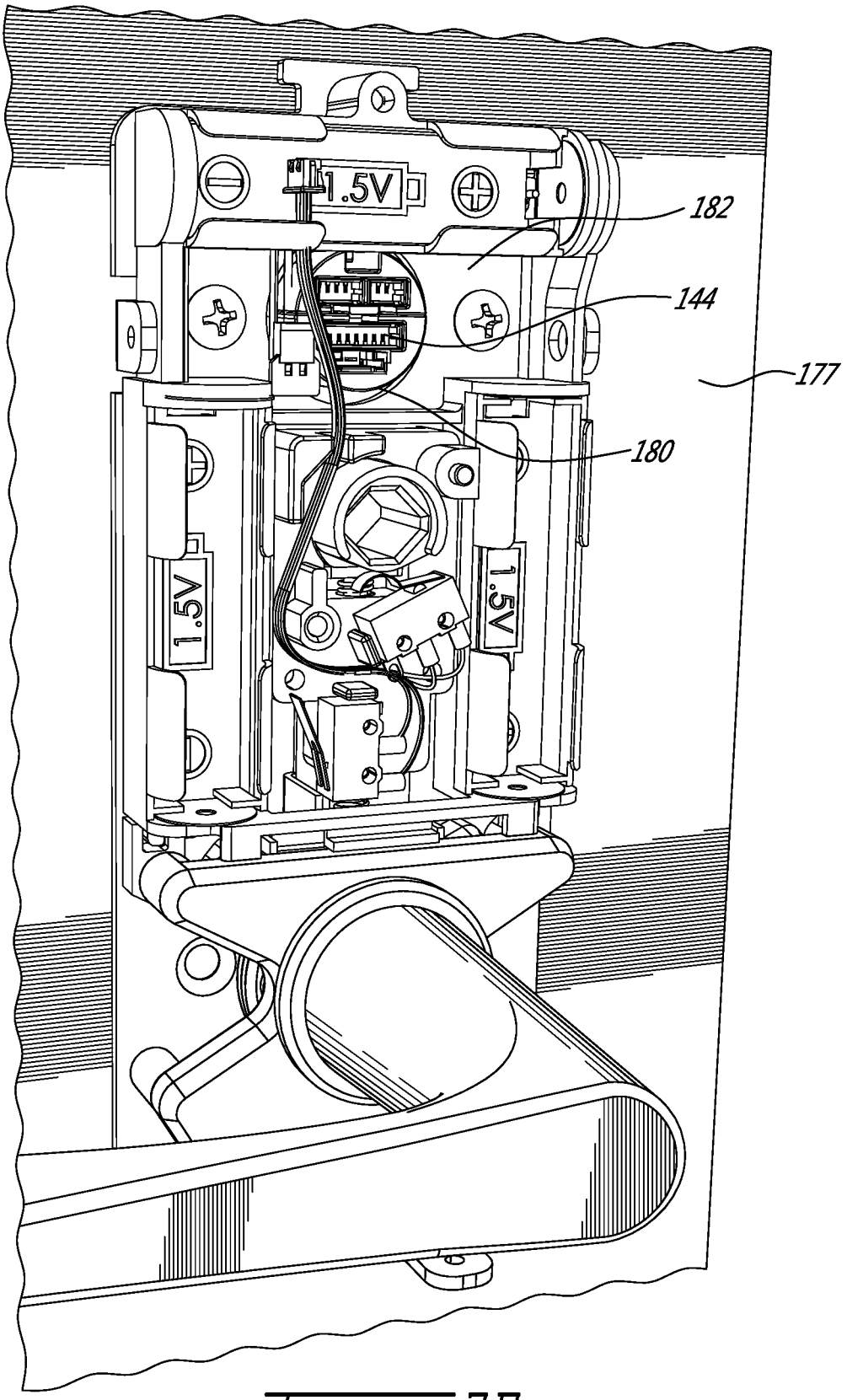

Another example of a telescoping wire conduit 140 is shown in FIGS. 3A and 3B. In this other example, the two telescoping members 142, 144 are engaged to one another via teeth 170 and pawl 172 engagement forming a ratchet 174, in a manner that the telescoping members 142, 144 can be extended linearly across the ratchet 174, and that the ratchet 174 can prevent a contrary retraction (compression) movement. The telescoping wire conduit is secured to and extends from a outer housing 148. In this embodiment, the telescoping wire conduit 140 can be shipped in its retracted state, such as shown in FIG. 3A. At the time of assembly, the technician can determine the thickness of the door, and extend the extension member 144 relative to the base member 142 selectively, to a level of extension which corresponds to the predetermined thickness of the door. At this stage, the technician can introduce the wire conduit 140 across the door 177, as it can be seen to extend across the mortise 178 for the purpose of illustration in FIG. 3C, and protrude slightly across a corresponding aperture 180 in the back plate 182 of the inner housing 184, such as shown in FIG. 3D, for wire connection. The pawl and teeth engagement can be designed in a manner that if the technician erroneously extends the extension member 144 too much, he can disengage the pawl from the teeth, return the extension member 144 to its retracted state, and retry. In FIG. 3C, the lock pocket is absent from the mortise for the purpose of illustration. During normal installation, in this embodiment, the lock pocket will have been engaged within the mortise 178 prior to engaging the wire conduit 140 across the door, and the wire conduit 140 will extend across a corresponding aperture formed within the lock pocket. It will be noted that in this embodiment, the connectors 186, at the end of the wires (not shown), are made integral to the extension member 144. In an alternate embodiment, the wire conduit 140 can extend above or below the mortise, or a telescoping wire conduit can be used for other lock types than mortise locks, such as latch locks, for instance.

Figure 4:
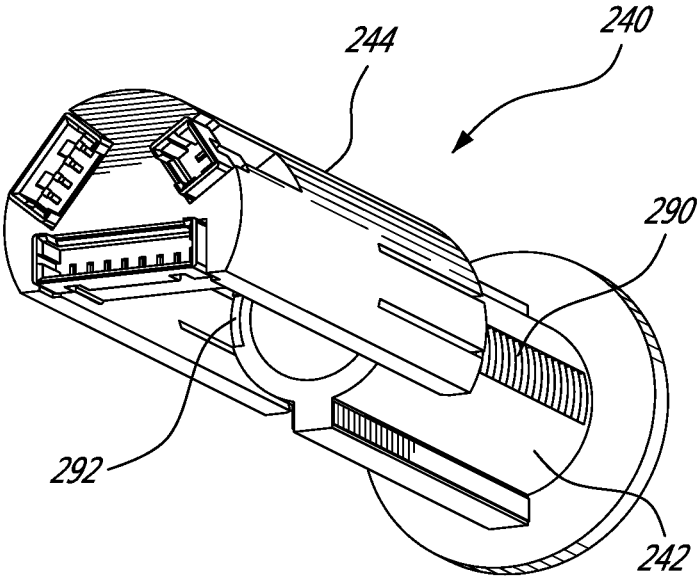
FIG. 4 is an oblique view of a third example of a telescoping wire conduit.

FIG. 4 shows another example of a telescoping member 240 having a ratchet-type engagement. In this example, there are two opposite ratchets 290, 292 which are diametrically opposite one another and are both longitudinally oriented, and the extension member 244 is external to the base member 242 rather than internal thereto as in the previous examples.

The telescoping wire conduit 40, 140, 240 can be used to adjust its length for different door thicknesses (e.g. 1-⅜" to 2-½"). 1, 2, 3, 4, or more cables can extend thereacross, depending on the specific type of locking system and the functions provided therewith.

Although it will be understood from the above that various alternate embodiments are possible, the details of a specific embodiment, for use as a possible example, will now be provided. More specifically, the telescoping wire conduit as shown in FIGS. 2A and 2B. The outer housing can include a RFID antenna (for a key card), a Zigbee antenna (for automated control of electrical equipment of the room), a bluetooth antenna (allowing to open the lock with a smart phone), a main PCB housing a primary controller unit of the locking system and an activation clutch. The inner housing can include the following components, all connected to the outer housing through the telescoping wire conduit: a lever switch to detect movement of the handle; a privacy switch to detect rotation of the turn knob; batteries (e.g. 3 AA batteries); a bluetooth antenna and a Zigbee antenna. The lock can, too, have an electrical component having a wire connected via the wire conduit. For instance, a mortise lock can have a door ajar switch wiredly connected to the outer housing via the wire conduit. In alternate embodiments, some or all of the components presented above can be omitted or be located at a different location (e.g. in the inner housing rather than in the outer housing).

Figure 5:
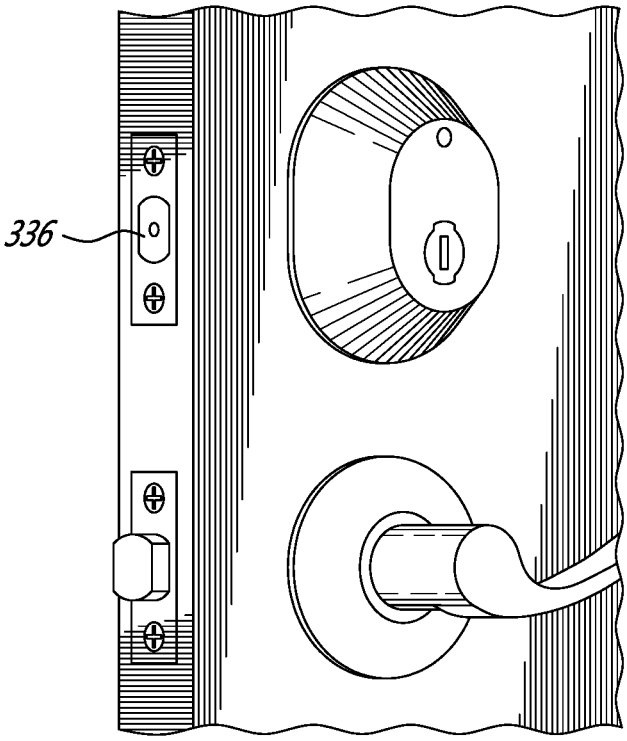
FIG. 5 Prior Art
FIG. 5 is a front elevation view of a second example of a locking system in accordance with the prior art.
Figure 6B:
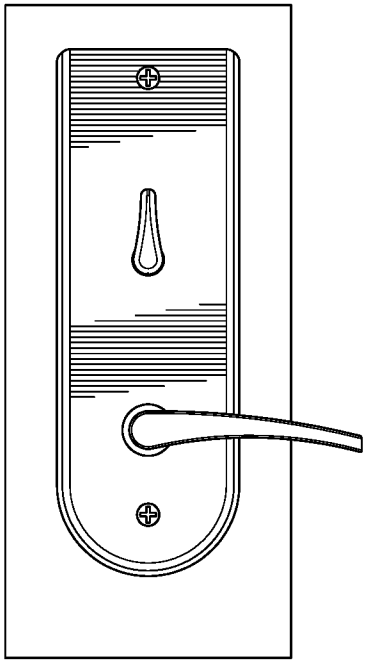
FIG. 6B Prior Art
FIGS. 6A and 6B are outside and internal views, respectively, of a third example locking system in accordance with the prior art.
Figure 6A:
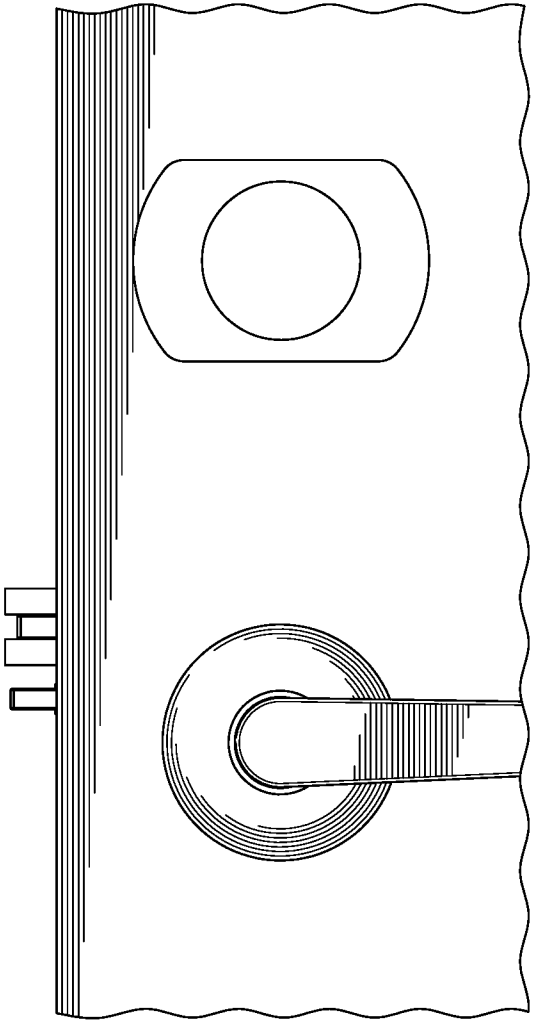
FIG. 6A Prior Art
Figure 8:
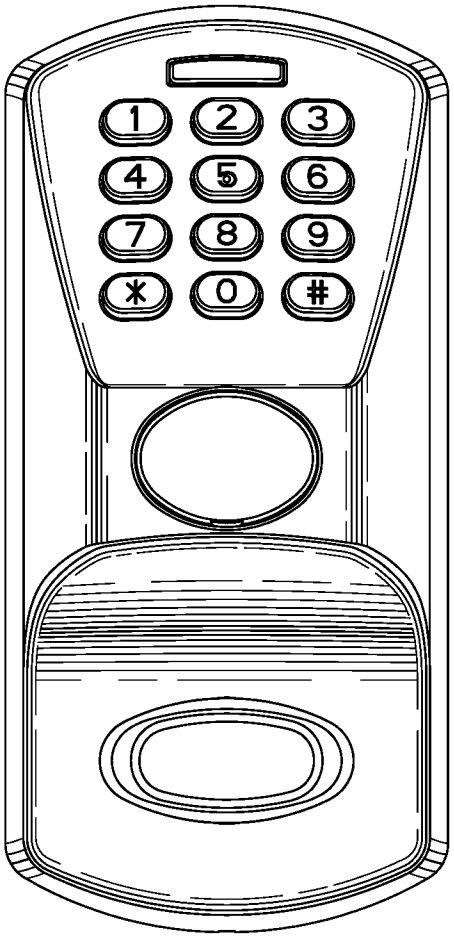
FIG. 8 Prior Art
FIG. 8 is a front elevation view of a fifth example of a locking system, in accordance with the prior art.
Figure 7:
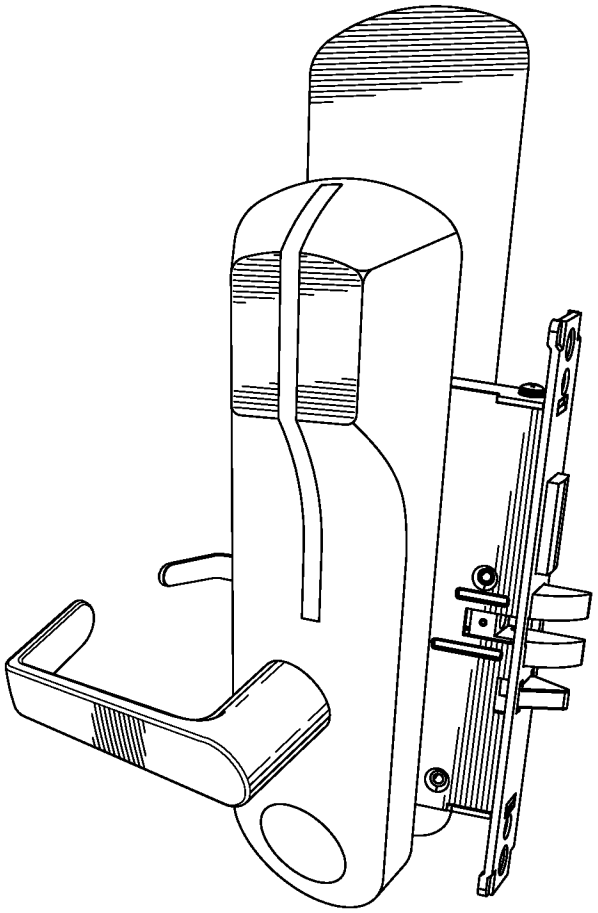
FIG. 7 Prior Art
FIG. 7 is an oblique view of a fourth example of a locking system, in accordance with the prior art.
Figure 9:
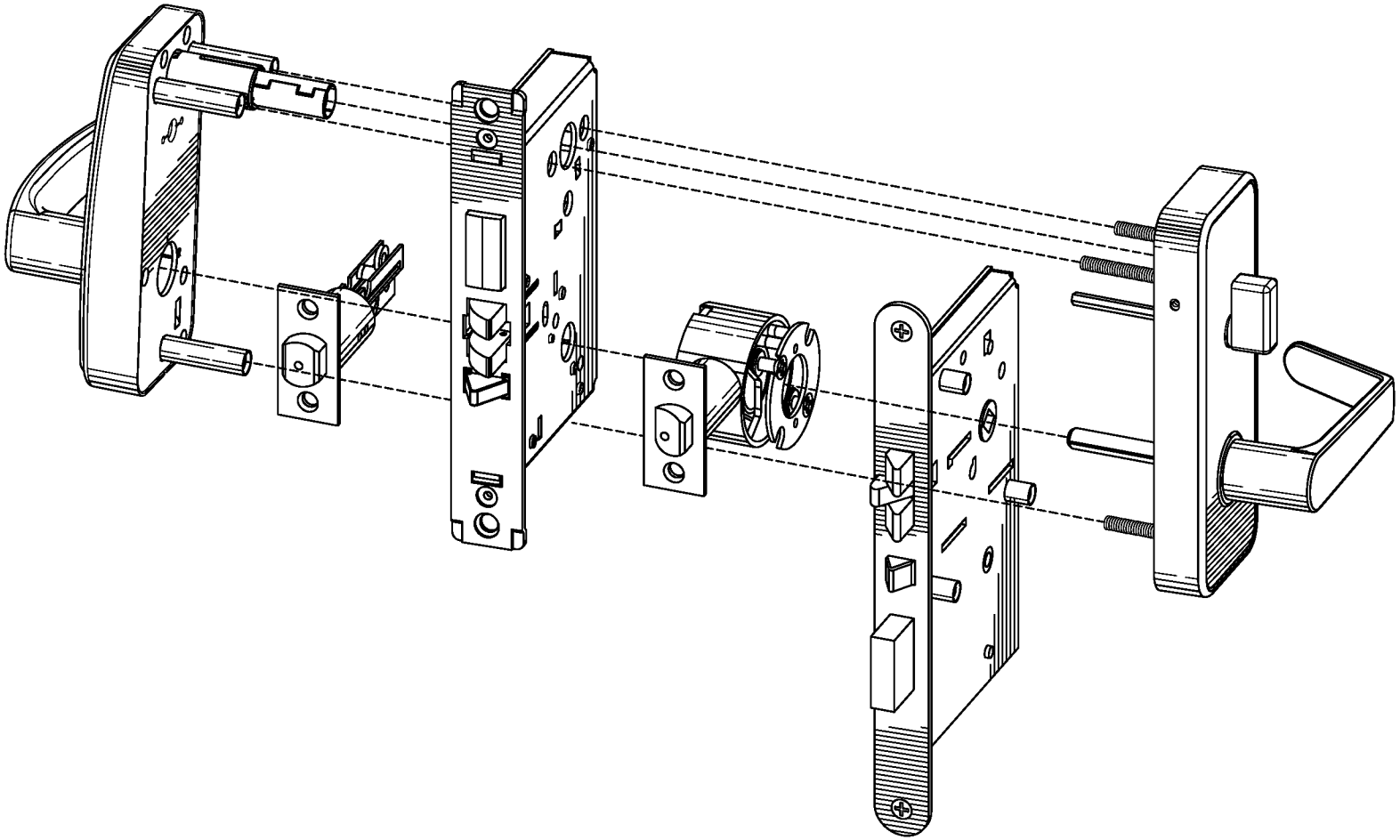
FIG. 9 is a schematic view showing variants.

As can be understood, the examples described above and illustrated are intended to be exemplary only. For instance, in the illustrated embodiments, both the base member and the extension member are generally cylindrical, but other telescoping shapes can be used in other embodiments. Moreover, in the illustrated embodiments, the telescoping wire conduit is made integral to the outer housing, but it will be understood that in alternate embodiments, it can be made integral to the internal housing instead, and extend towards to the outer housing for connection of the wires thereto. Also, although the detailed examples provided above are well adapted to be embodied with mortise-type locks, it will be understood that the telescoping wire conduit can be adapted to other types of lock systems. For instance, FIG. 5 shows a lock having an electronic deadbolt 336, and a telescoping wire conduit can be used to pass wires associated with the electronic deadbolt 336 across the door. FIGS. 6A and 6B show a lock system in which a reader is provided in a housing on the outer face of the door, but is separate from the lever (FIG. 6A shows the outer face whereas FIG. 6B shows the inner face). FIG. 7 shows an embodiment where the lock system has a "swipe"-type card reader. FIG. 8 shows an embodiment where the lock system has a keypad-type interface for receiving a numerical key. Moreover, it will be understood that the telescoping wire conduit can be used to connect various types of electrical components which require wired connections across the door, and that in various forms of locks, the exact nature and location (inner housing or outer housing) of such electrical components can vary. For the purpose of illustration, FIG. 9 is provided to show various alternatives of locks which can be used between an inner housing and an outer housing, more specifically: a dead bolt lock, an american mortise lock, a latch lock, and a european mortise lock. Other types of locks can be used in alternate embodiments. It will be understood that a telescoping wire conduit can be used in association with any one of the examples presented above and illustrated, as found suitable by persons skilled in the art. The scope is indicated by the appended claims.

What is claimed is:

1. A locking system for a door having a lock, the locking system comprising an outer housing mounted to an outside face of the door, and an inner housing mounted to an inside face of the door, a wire conduit mounted to one of the inner housing and the outer housing and extending across the door to the other one of the inner housing and the outer housing, the wire conduit having two telescoping members, and at least one wire extending inside the wire conduit and connected between a first locking system component housed in the outer housing and a second locking system component housed in the inner housing.

2. The locking system of claim 1 wherein the two telescoping members include a base member and an extension member, the base member having a proximal end secured to said one of the inner housing and the outer housing and a distal end extending into the door, and having a keyway including a longitudinal segment extending longitudinally between the proximal end and a distal end of the base member, and a circumferential segment at the distal end, and the extension member has a radially-extending protuberance forming a key being engaged in the keyway, wherein the two telescoping member can be locked into an extended position for installation, in which the key is engaged with the circumferential segment, and unlocked from the extended position by moving the key into the longitudinal segment, for retracting the extension member once the wire connections have been made.

3. The locking system of claim 2 wherein the two telescoping members are engaged to one another via a teeth and pawl engagement forming a ratchet, in a manner that the telescoping members can be extended linearly across the ratchet, and that the ratchet can prevent a contrary retraction movement.

4. The locking system of claim 1 wherein the locking system includes a plurality of electrical locking system components including the first locking system component and the second locking system component, the electrical locking system components individually being housed in one of the outer housing and the inner housing; wherein the plurality of electrical locking system components include at least: a battery, a reader for receiving an input from an electronic key, a lock actuator operable to activate the lock, a controller being adapted for receiving the input from the reader, determining whether or not the corresponding electronic key is authorized to open the lock, and to control the lock actuator based on said determination.

5. The locking system of claim 1 wherein the lock is a mortise lock forming part of a pack received in a mortise formed into the door, and wherein said wire conduit extends across the pack.

6. The locking system of claim 1 wherein the second locking system component is a battery which is housed in the inner housing.

7. The locking system of claim 1 wherein the wire conduit is mounted to the outer housing and extends towards the inner housing across the door.

8. The locking system of claim 1 wherein the wire conduit has a retraction prevention feature which can be used to prevent undesired retraction of the wire conduit during installation.

9. The locking system of claim 1 wherein the retraction prevention feature is a ratchet engagement.

10. A method of installing a locking system having an outer housing, an inner housing and a lock, to a door, the method comprising extending a telescoping wire conduit mounted to one of the outer housing and the inner housing of the locking system, mounting the outer housing to an outer face of the door and the inner housing to an inner face of the door, including engaging a free end of the extended telescoping wire conduit across the door, and connecting at least one wire extending out from the free end of the wire conduit.

11. The method of claim 10 further comprising, subsequently to said connecting, unlocking and retracting the telescoping wire conduit.

12. The method of claim 10 wherein said step of extending the telescoping wire conduit includes selectively extending the telescoping wire conduit to a length corresponding to a predetermined thickness of the door against a ratchet engagement which prevents retraction.

* * * * *